US006012715A

United States Patent [19]

Kasahara

[11] Patent Number: 6,012,715

[45] Date of Patent: Jan. 11, 2000

[54] RECORDING PAPER TURNING-OVER APPARATUS

[75] Inventor: Rikio Kasahara, Asahi-Ku, Japan

[73] Assignee: Ricoh Company, Ltd., Tokyo, Japan

[21] Appl. No.: 09/048,157

[22] Filed: Mar. 26, 1998

[30] Foreign Application Priority Data

Mar. 26, 1997 [JP] Japan ..... 9-073882

[51] Int. Cl.[7] ..... B65H 29/00

[52] U.S. Cl. ..... 271/186; 271/188

[58] Field of Search ..... 271/65, 184, 185, 271/186, 188

[56] References Cited

U.S. PATENT DOCUMENTS

| | | | |
|---|---|---|---|
| 3,942,785 | 3/1976 | Stange | 271/65 |
| 4,673,176 | 6/1987 | Schenk | 271/186 |
| 5,058,877 | 10/1991 | Fujiwara et al. . | |
| 5,222,725 | 6/1993 | Kasahara et al. . | |
| 5,234,210 | 8/1993 | Olexy | 271/184 |
| 5,265,864 | 11/1993 | Roux et al. | 271/186 |
| 5,390,006 | 2/1995 | Wakabayashi et al. . | |
| 5,464,200 | 11/1995 | Nakazato et al. . | |

FOREIGN PATENT DOCUMENTS

| | | | |
|---|---|---|---|
| 0069534 | 6/1977 | Japan | 271/186 |
| 0041347 | 2/1988 | Japan | 271/188 |
| 0013452 | 1/1991 | Japan | 271/186 |

*Primary Examiner*—H. Grant Skaggs
*Attorney, Agent, or Firm*—Oblon, Spivak, McClelland, Maier & Neustadt, P.C.

[57] ABSTRACT

A recording paper turning-over apparatus performing an operation of turning-over a recording paper with low cost and high reliability. A first roller pair including a combination of a transport roller and a transport pinch roller is disposed at an inlet side of a turning-over unit. Another roller pair including a combination of a turning-over roller and a turning-over pinch roller is disposed downstream of the first roller pair. Convex portions of the transport roller are brought into direct contact with the turning-over roller, which in turn is driven by the transport roller. Concave and convex portions of the transport roller and the transport pinch roller are mutually alternated and engaged. The concave and convex portions of the turning-over roller and the turning-over pinch roller are also mutually alternated and engaged.

18 Claims, 6 Drawing Sheets

| | RECORDING PAPER (WEIGHT) | 35 kg | 45 kg | 55 kg | 70 kg | 90 kg | 110kg | |
|---|---|---|---|---|---|---|---|---|
| 1-1 | TRANSPORTATION TEST AT THE TIME OF FIXING THE TRANSPORT PINCH ROLLER 22 | ○ | ○ | △<br>LOAD; LARGE | ×<br>NOT ADVANCING | ×<br>NOT ADVANCING | ×<br>NOT ADVANCING | △ |
| 1-2 | TURNING-OVER TEST AT THE TIME OF FIXING THE TURNING-OVER PINCH ROLLER 24 | ×<br>REAR END BUCKLING | ○ | ○ | — | — | — | △ |
| 1-3 | TRANSPORT PINCH ROLLER 22; ROCKINGLY MOVE | ADVANCING ○<br>NOT ENTERING TURNING-OVER ROLLER; BUCKLING<br>× | ADVANCING ○<br>NOT ENTERING TURNING-OVER ROLLER; BUCKLING<br>× | ADVANCING ○<br>AT THE TIME OF TURNING-OVER; REAR END, BROKEN<br>× | ADVANCING ○<br>AT THE TIME OF TURNING-OVER<br>○ | ADVANCING ○<br>AT THE TIME OF TURNING-OVER<br>○ | ADVANCING ○<br>AT THE TIME OF TURNING-OVER<br>○ | ○ |
| 1-4 | TRANSPORT PINCH ROLLER 22 AND TURNING-OVER PINCH ROLLER 24; ROCKINGLY MOVE | ADVANCING ○<br>TURNIN-OVER ○ | ADVANCING ○<br>TURNIN-OVER ○ | ADVANCING ○<br>TURNIN-OVER ○ | ADVANCING ○<br>TURNIN-OVER ○ | ADVANCING ○<br>TURNIN-OVER ○ | ADVANCING ○<br>TURNIN-OVER ○ | ✳ |

*FIG. 6*

| RECORDING PAPER REVERSE TRANSPORTATION FORCE \ WEIGHT OF RECORDING PAPER | 35 kg | 45 kg | 55 kg | 70 kg | 90 kg | 110kg | |
|---|---|---|---|---|---|---|---|
| 10gf | ○ | ○ | ○ | × TURNING-OVER; NO GOOD | × TURNING-OVER; NO GOOD | × TURNING-OVER; NO GOOD | △ |
| 20gf | ○ | ○ | ○ | × TURNING-OVER; NO GOOD | × TURNING-OVER; NO GOOD | × TURNING-OVER; NO GOOD | △ |
| 30gf | ○ | ○ | ○ | ○ | × TURNING-OVER; NO GOOD | × TURNING-OVER; NO GOOD | ○ |
| 50gf | ○ | ○ | ○ | ○ | ○ | ○ | * |
| 70gf | ○ | ○ | ○ | ○ | ○ | ○ | * |
| 90gf | ○ | ○ | ○ | ○ | ○ | ○ | * |
| 110gf | ○ | ○ | ○ | ○ | ○ | ○ | * |
| 130gf | × BUCKLING | △ BUCKLING; EXISTING | ○ | ○ | ○ | ○ | ○ |
| 150gf | × | × | ○ | ○ | ○ | ○ | ○ |
| 170gf | × | × | ○ | ○ | ○ | ○ | ○ |
| 200gf | × | × | ○ | ○ | ○ | ○ | ○ |

*FIG. 7*

RECORDING PAPER TURNING-OVER APPARATUS

BACKGROUND OF THE INVENTION

1. Field of the Invention

The present invention relates to a recording paper turning-over apparatus, and in particular, to an automatic recording paper turning-over apparatus, equipped in an image forming apparatus, employed for automatically turning-over recording paper in order to form images on both surfaces of recording paper.

2. Discussion of the Background Art

An image forming apparatus for forming images on both surfaces of a recording paper, that is, an image forming apparatus having a so-called both-surfaces image forming mode, is well known. Such an image forming apparatus is equipped with a recording paper turning-over apparatus for automatically turning-over the recording paper in order to form images on both surfaces of the recording paper.

For instance, the published specification of Japanese Laid-Open Patent Publication No. 8-59046/1996 describes a construction in which a pinch roller of a nip release roller apparatus, capable of being normally and inversely driven, is provided to be releasably attached to and detached from a driving roller. An operation of releasing the pinch roller in the nip release roller apparatus is performed in accordance with information from a recording paper detecting unit disposed at a predetermined position.

However, in the above-mentioned background apparatus, unevenness of a pressurizing force in the back-and-forth direction or in the axis direction perpendicular thereto in relation to the recording paper transporting direction tends to occur easily when the pinch roller is brought into contact with a paper turning-over roller. As a result, a high precision for assembling parts of the apparatus is required, and the cost of assembling the parts, including the noted rollers and other parts such as a sensor, a motor employed for rotating inversely, a changing-over claw, etc., is inevitably raised. Furthermore, a waiting time for adjusting a timing is lost, and therefore the above apparatus is not suitable for performing an operation of both-surfaces printing with high speed.

SUMMARY OF THE INVENTION

The present invention was made in consideration of the above-mentioned and other problems in order to overcome such above-mentioned and other problems.

It is one object of the present invention to solve and improve the above-mentioned problems in the background art.

It is another object of the present invention to provide a recording paper turning-over apparatus which can realize a high-speed performance with low cost, and which can execute an operation of turning-over recording paper with high reliability.

It is still another object of the present invention to provide a recording paper turning-over apparatus which can reduce assembling costs.

It is still another object of the present invention to provide a recording paper turning-over apparatus which does not require high precision for assembling parts in order to further reduce assembling costs.

It is still another object of the present invention to provide a recording paper turning-over apparatus which can reduce waiting loss time in adjusting a timing, and thereby can perform a both-surfaces printing operation with high speed.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 6 is a table showing results of a first example of a experiment of an operation of an embodiment of the present invention; and FIG. 7 is another table showing results of a second example of an experiment of an operation of an embodiment of the present invention.

DESCRIPTION OF THE PREFERRED EMBODIMENT

Figure 1:
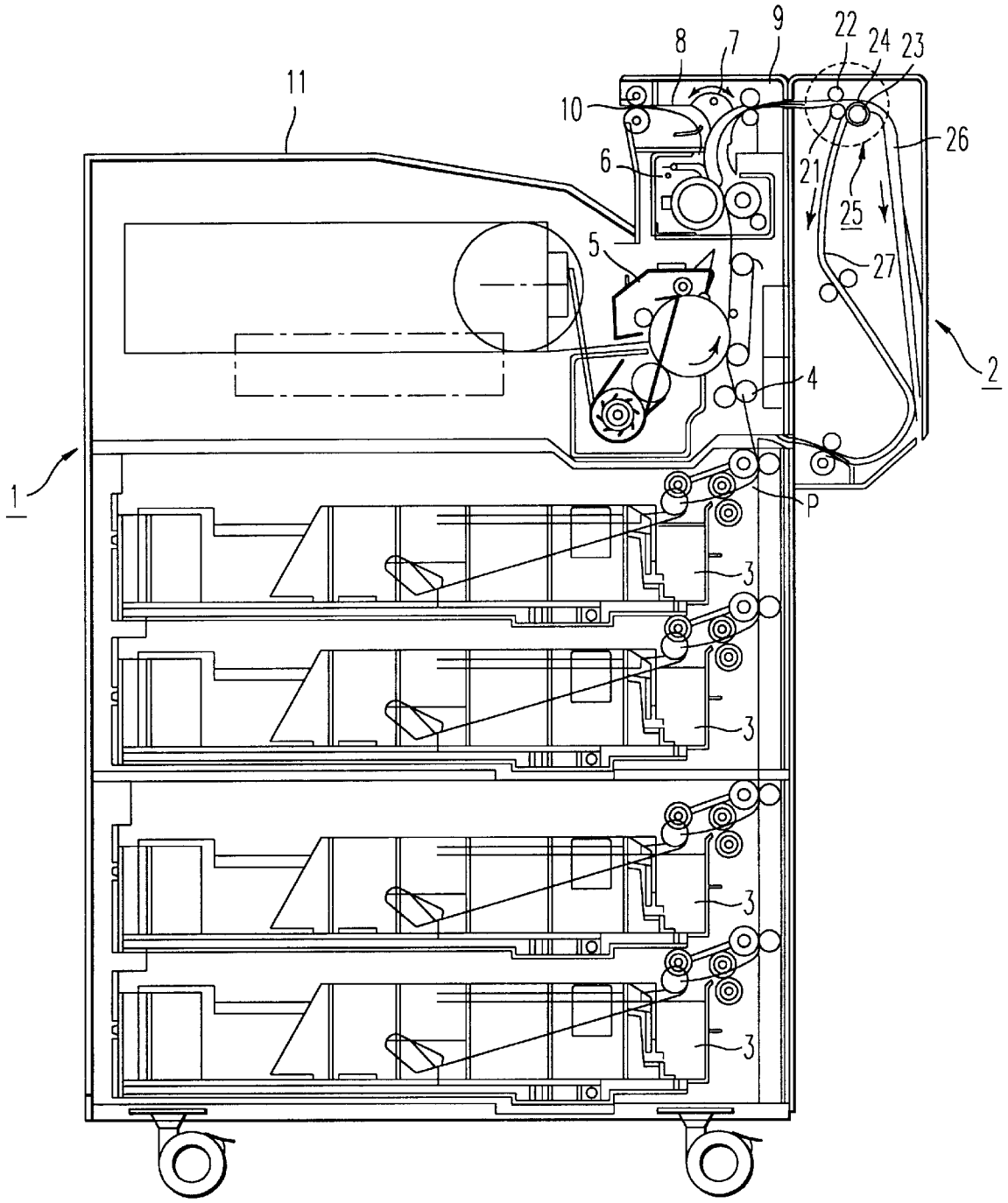
FIG. 1 is a side cross-sectional view showing an overall construction of an image forming apparatus utilizing a recording paper turning-over apparatus of an embodiment of the present invention.

An embodiment of the present invention is described hereinafter, referring to the accompanying drawings, wherein like reference numerals designate identical or corresponding parts throughout.

FIG. 1 is a side cross-sectional view showing a construction of an overall image forming apparatus utilizing a recording paper turning-over apparatus relating to an embodiment of the present invention.

The image forming apparatus shown in FIG. 1 is provided with a turning-over unit 2 mounted on one side portion of an apparatus main body 1. The apparatus main body 1 is provided with, e.g., four-stages paper feeding cassettes 3 on the bottom of the apparatus main body 1. The apparatus main body 1 also includes a registration roller 4, an image creating portion 5 constructed with a photosensitive drum and electrophotographic process media arranged on a circumference of the photosensitive drum, and a fixing unit 6 arranged in a paper transporting path, in this order upstream from a direction of transporting recording paper P.

Furthermore, a changing-over claw 7 is disposed downstream of the fixing unit 6, and the changing-over claw 7 directs the recording paper P to either one of a paper discharging path 8 or a paper turning-over path 9. A paper discharging roller 10 is disposed downstream of the paper discharging path 8, and the paper discharging roller 10 faces a paper discharging tray 11 formed on the upper surface of the apparatus main body 1. The turning-over path 9 opposes an opening portion of the turning-over unit 2, and the recording paper P is transported into the turning-over unit 2 through the turning-over path 9.

The turning-over unit 2 is constructed with a turning-over mechanism portion 25 composed of a transport roller 21, a transport pinch roller 22, a turning-over roller 23, a turning-over pinch roller 24, a sheltering path 26, and a turning-over path 27. The details of the turning-over mechanism portion 25 are described below, referring to FIG. 2 and the other subsequent figures.

Next, an operation of transporting the recording paper P in the image forming apparatus of such a structure of FIG. 1 is described hereinafter.

When one of the four paper feeding cassettes 3 is selected, recording paper P is fed one by one from the selected cassette 3 and is transported into a paper transporting path. The recording paper P thus transported is stopped once temporarily. And then, the recording paper P is sent out to the image creating portion 5 in synchronism with a tip end of an image formed on the photosensitive drum of the image creating portion 5. The image is then formed on (transferred to) a first side surface of the recording paper P. Then, the recording paper P is sent to the fixing unit 6.

When operating in a both-surfaces copying mode, the changing-over claw 7 is rockingly moved in the clockwise direction around a support axis thereof, and thereby the recording paper P is directed toward the turning-over path 9. In such a way, the recording paper P is taken in the turning-over unit 2.

Although the details of the turning-over operation are described later together with the construction of the turning-over mechanism portion 25, in the turning-over unit 2 a tip end portion of the recording paper P is transported once temporarily into the sheltering path 26. And thereafter, the rear end of the recording paper P (the rear end thereof in the direction of transporting the recording paper P until entering the turning-over unit 2) is rendered to be the front end at this time, and the recording paper P is then transported into the turning-over path 27. The recording paper thus transported proceeds to the side of the apparatus main body 1 and again arrives at the registration roller 4.

The recording paper P then waits at the registration roller 4. Since the side of the recording paper opposing the image forming portion 5 is a white (blank) surface, the recording paper P is sent out to the image forming portion 5 by the registration roller 4, and then an image can be formed on the rear second surface of the recording paper P. As a result, images are formed on both surfaces of the recording paper P to be fixed by the fixing unit 6.

The changing-over claw 7 is rockingly moved at this time in the counterclockwise direction. The paper discharging path 8 then becomes opened at this time. In such a state, the recording paper P passes through the paper discharging path 8 and is stacked (piled) on the paper discharging tray 11. In such a manner, all operations of the both-surfaces copying mode come to an end.

Next, the recording paper turning-over apparatus 2 is described in greater detail hereinafter.

Figure 2:
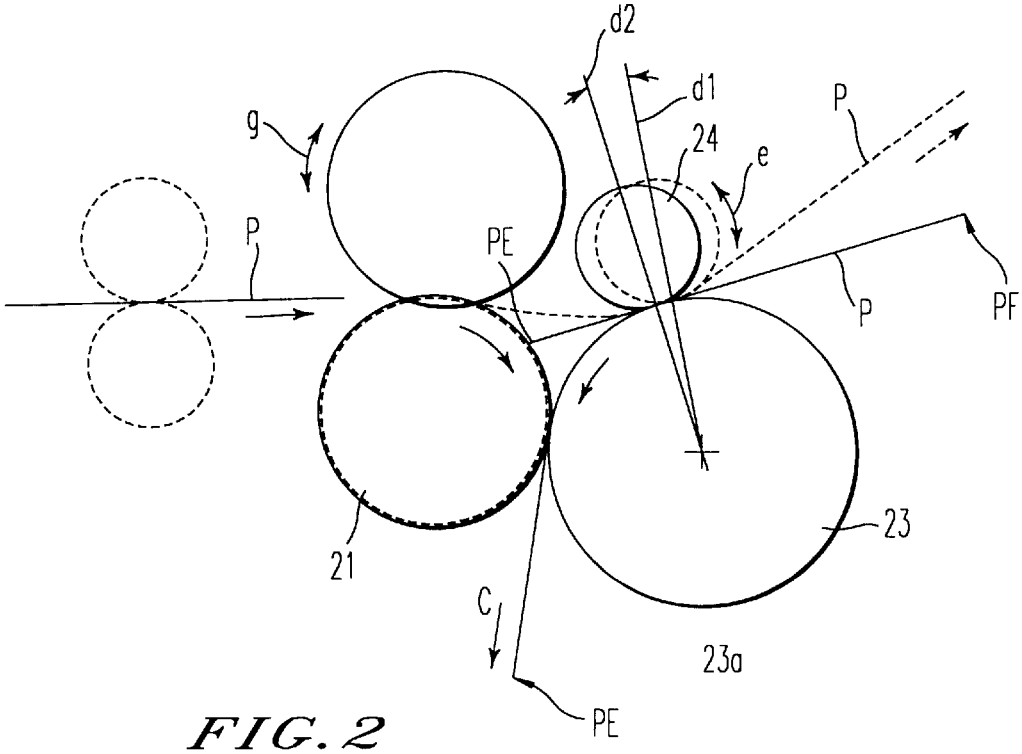
FIG. 2 is an enlarged structural diagram showing a turning-over mechanism in the recording paper turning-over apparatus shown in FIG. 1.
Figure 3:
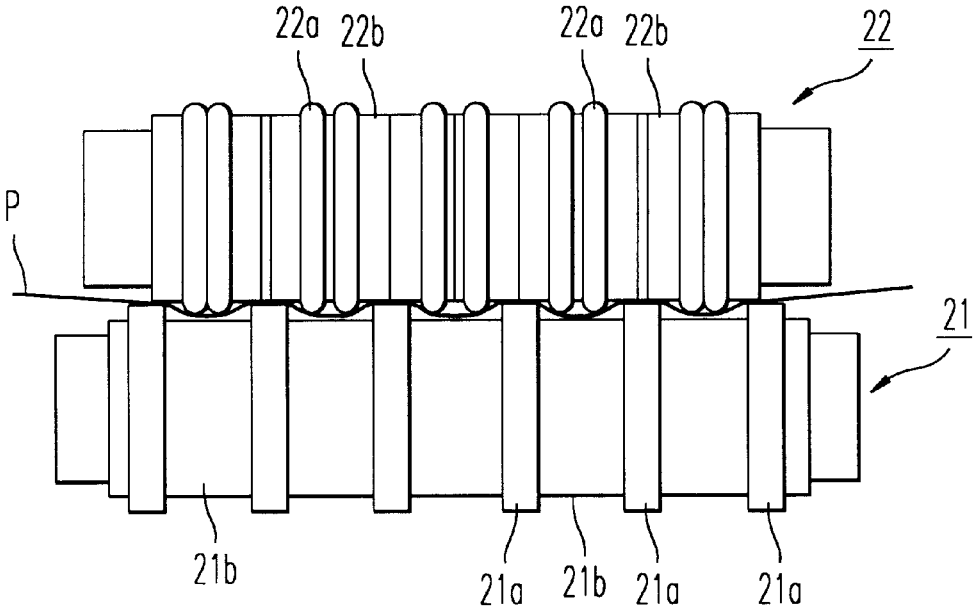
FIG. 3 is a structural view in a lengthwise direction showing an arrangement of a transport roller and a transport pinch roller of FIG. 2.
Figure 4:
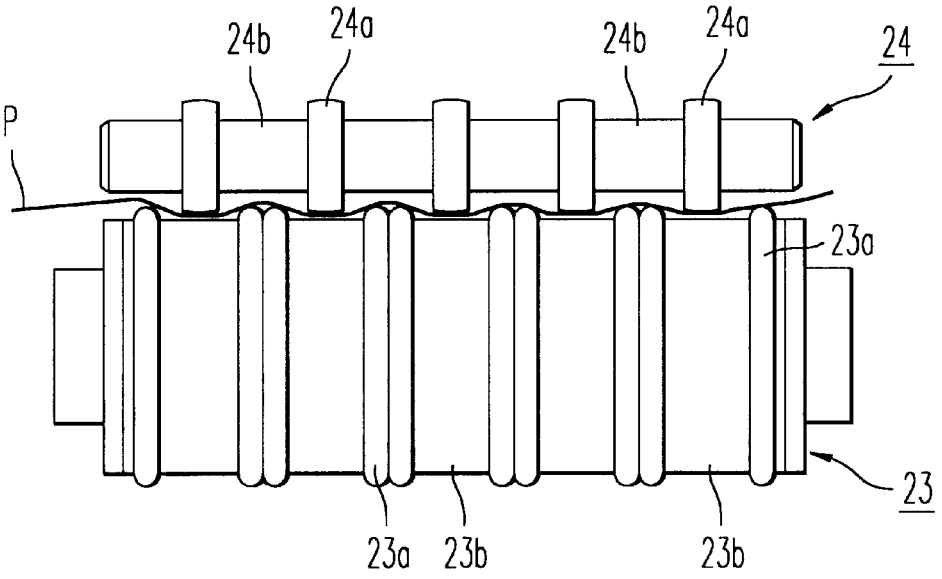
FIG. 4 is a structural view in a lengthwise direction showing an arrangement of a turning-over roller and a turning-over pinch roller of FIG. 2.

FIG. 2 is an enlarged structural diagram showing a turning-over mechanism in the recording paper turning-over apparatus shown in FIG. 1. FIG. 3 is a structural view in a lengthwise direction showing an arrangement of the transport roller 21 and the transport pinch roller 22 both shown in FIG. 2. FIG. 4 is a structural view in a lengthwise direction showing an arrangement of the turning-over roller 23 and the turning-over pinch roller 24 also both shown in FIG. 2.

As shown in FIGS. 2–4, a first pair of rollers includes a combination of the transport roller 21 and the transport pinch roller 22 constructing a transport mechanism portion at an inlet side (upstream side) of the turning-over unit 2. A second pair of rollers includes a combination of the turning-over roller 23 and the turning-over pinch roller 24 constructing a turning-over mechanism portion at an outlet side (downstream side) of the turning-over unit 2.

Furthermore, a convex portion 21*a* of the transport roller 21 can be brought into direct contact with a convex portion 23*a* of the turning-over roller 23. In such a structure, the turning-over roller 23 is driven by the transport roller 21.

As shown in FIG. 3, convex portions 21*a* and concave portions 21*b* of the transport roller 21 can be formed at equal intervals in the axis direction thereof, on the transport roller 21. On the other hand, convex portions 22*a* and concave portions 22*b* of the transport pinch roller 22 can be formed at equal intervals in the axis direction thereof, on the transport pinch roller 22. Furthermore, the convex portions and the concave portions of the both rollers 21 and 22 can alternate with each other, and both of the convex and concave portions of the rollers 21 and 22 can engage with each other in a state of non-contact.

Furthermore, as shown in FIG. 4, the turning-over roller 23 has convex portions 23*a* and concave portions 23*b*, and the turning-over pinch roller 24 has also convex portions 24*a* and concave portions 24*b*. The convex and concave portions of the rollers 23 and 24 can alternate with each other, and both of these convex and concave portions of the rollers can engage with each other in a state of non-contact.

As mentioned above, the convex portions 21*a* of the transport roller 21 can always be brought into contact with the convex portions 23*a* of the turning-over roller 23 corresponding to the above-mentioned convex portions 21*a*. Consequently, an operation of turning over the recording paper can be performed only by the action of the driving force of the transport roller 21. As a result, it is sufficient to require only one driving source for transport roller 21, and thereby a cost-reduction can be achieved.

The transport pinch roller 22 is constructed to be rockingly moved in the direction "g" shown in FIG. 2 to change the gap between the transport pinch roller 22 and the transport roller 21 in accordance with thickness and rigidity of the recording paper P guided to the nip portion between the transport roller 21 and the transport pinch roller 22.

In a case that the rigidity of the recording paper P is high or the thickness thereof is large, the gap between the transport pinch roller 22 and transport roller 21 becomes large, and vice versa. In such a structure, as shown in FIG. 3, the paper transporting load can be made constant, corresponding to the rigidity and the thickness of the recording paper P. In addition, it is possible to give the recording paper P property of waist (rigidity of the paper for preventing the paper from being easily bent).

Moreover, although the turning-over pinch roller 24 is engaged with the turning-over roller 23 with a constant gap, the turning-over pinch roller 24 can be rockingly moved up and down (in the direction shown by the arrow "e" in FIG. 2) in accordance with the rigidity and thickness of the recording paper P, and/or the turning-over pinch roller 24 can be moved back and forth (back and forth in the direction of transporting the recording paper P) between the positions respectively shown by the solid line and the dotted line in FIG. 2. Namely, the turning-over pinch roller 24 can be moved back and forth in the area defined by the lines d1 and d2 respectively connecting the center of the turning-over roller 23 to the centers of the positions of the turning-over pinch rollers 24 represented respectively by the solid line and the dotted line. In such a structure, the recording paper P can be prevented from being bent buckling owing to the rigidity (waist) of the recording paper P itself.

As shown in FIG. 2, since the turning-over pinch roller 24 is disposed so as to incline to the side of the transport pinch roller 22, in other words, since the straight lines d1 and d2 respectively connecting the axis of the turning-over roller 23 to the axes of the turning-over pinch rollers 24 are inclined to the side of the transport pinch roller 22, the tip (front) end portion PF of the recording paper P, which is diagrammatically shown by a straight line coinciding with a tangent line passing through the nip portion between the turning-over roller 23 and the turning-over pinch roller 24, is inclined upward.

On the other hand, the rear end portion PE of the recording paper P is situated at a lower position than the nip portion between the transport roller 21 and the transport pinch roller 22. In such a structure, the rear end PE of the recording paper P can be easily drawn in toward the nip portion between the transport roller 21 and the turning-over roller 23.

Furthermore, as shown in FIG. 3, a knurled portion (not shown) with grooves can be formed on the outer circumferential surface of the convex portion 21*a* of the transport roller 21, and as a result the rear end PE of the recording paper P is pressed against the convex portion 21*a* of the transport roller 21 by action of an inverse transportation force of the turning-over roller 23 and, at this time, the edge of the rear end PE of the recording paper P is engaged with the knurled portion (not shown) of the transport roller 21 and is held thereon in the process of rotating the transport roller 21 in the positive (normal) direction. The recording paper P thus engaged with and held on the knurled portion of the transport roller 21 is drawn in toward the nip portion between the transport roller 21 and the turning-over roller 23. Thereby, the recording paper P can be transported further easily in the direction "c", namely, in the direction of turning-over the recording paper P.

Even if such a knurled portion (not shown) was not provided, the operation of turning-over the recording paper P could still be performed. However, by providing a knurled portion (not shown) on an outer circumferential surface of the transport roller's convex portion 21*a*, the turning-over operation can be performed more surely. Moreover, a member having a high friction coefficient can be stuck on the outer circumferential surface of the convex portion 21*a*.

Next, specifics of the operation of turning over the recording paper P is described hereinafter, referring to FIG. 2.

Initially, the recording paper P transported through the turning-over path 9 (see FIG. 1) of the apparatus main body 1 is nipped (held) at the nip portion between the transport roller 21 and the transport pinch roller 22. Here, a recording paper P of high rigidity (treated with applying waist to the recording paper P) is pushed into the gap between the turning-over roller 23 and the turning-over pinch roller 24. At this time, the front end PF of the recording paper enters into the sheltering path 26 shown in FIG. 1.

When the rear end PE of the recording paper P passes past the nip portion between the transport roller 21 and the transport pinch roller 22, the rear end PE of the recording paper P is pressed against the convex portion 21*a* of the transport roller 21 downstream of the nip portion therebetween, and thereby can engage with a knurled portion (not shown) formed on the convex portion 21*a*, if utilized as mentioned before. And then, the rear end PE of the recording paper is nipped by the nip portion between the transport roller 21 and the turning-over roller 23 and is then transported in the direction "c". Namely, the rear end PE of the recording paper P is now rendered to be the front end, and the recording paper P is transported passing through the turning-over path 27 shown in FIG. 1.

Figure 5:
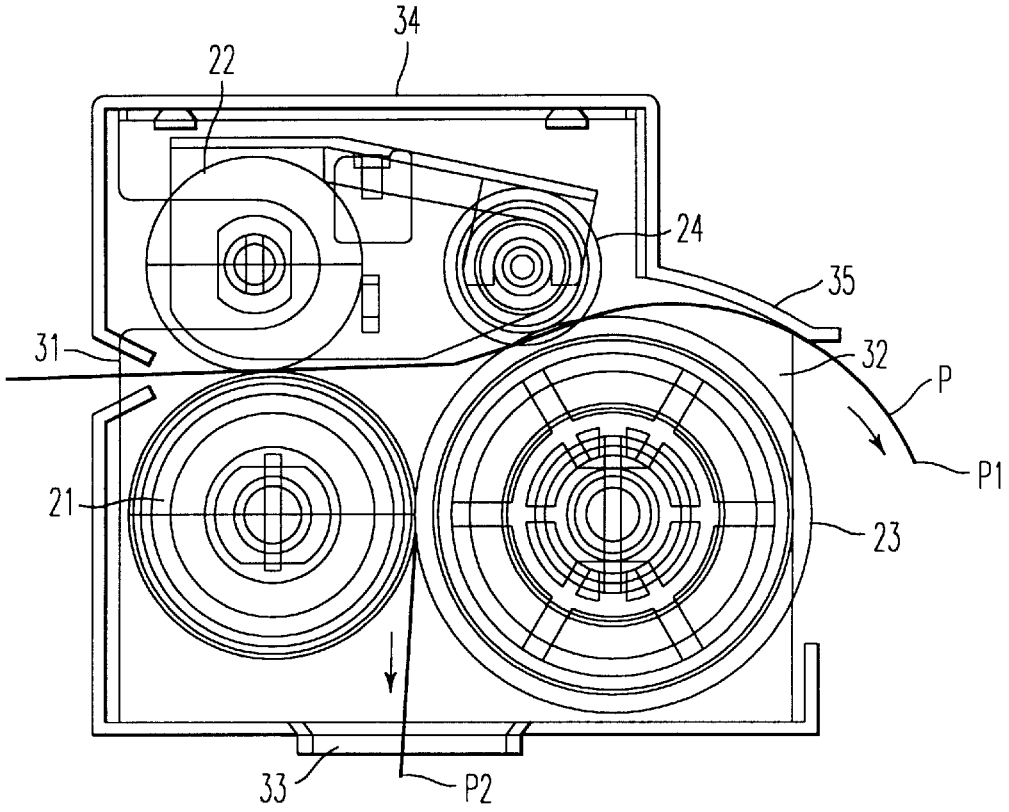
FIG. 5 is a structural cross-sectional view of a turning-over mechanism portion constructed as one unit according to the present invention.

Next, an example of a turning-over mechanism portion 25 constructed as one unit according to the present invention is described hereinafter, referring to FIG. 5. That is, FIG. 5 is a structural cross-sectional view of a turning-over mechanism portion 25 constructed as one unit according to the present invention.

The transport roller 21, the transport pinch roller 22, the turning-over roller 23, and the turning-over pinch roller 24 are accommodated in a housing 34 having respective openings 31, 32, and 33. The openings include an inlet portion 31 for the recording paper P, an outlet portion 32 for the front end of the recording paper P, and another outlet portion 33 for the rear end of the recording paper P. These elements construct a turning-over mechanism unit as a whole.

The recording paper inlet portion 31 is formed toward the turning-over path 9 shown in FIG. 1. The recording paper front end outlet portion 32 is formed toward the sheltering path 26. The recording paper rear end outlet portion is formed toward the turning-over path 27. A restriction guide 35 for restricting jumping up of the recording paper P is formed at an upper portion near the recording paper front end outlet portion 32.

In such a manner as mentioned above, by constructing the turning-over mechanism portion 25 as one unit, the easiness of assembling the turning-over unit 2 and the easiness of mounting the turning-over mechanism portion 25 in the turning-over unit 2 can be improved, and thereby the reliability of the turning-over unit 2 can be enhanced. Furthermore, the recording paper P can be smoothly guided into the sheltering path 26 owing to the existence of the restriction guide 35.

Moreover, it is needless to mention that, in the above embodiments, the respective numbers of the concave portions and the convex portions respectively formed on the transport roller 21, the transport pinch roller 22, the turning-over roller 23, and the turning-over pinch roller 24 can be set (decided) optionally, for these four rollers 21, 22, 23, and 24.

Next, experimental results demonstrating the easiness of transporting the recording paper P at a time of transporting the recording paper P in the normal and reverse directions and the condition of paper buckling (rigidity of the paper) in the present embodiments, and comparison examples thereof, are illustrated in summary in the table of FIG. 6 (the table showing results of a first experiment).

In the above experiment, a test of transportation (1-1) at a time of fixing the transport pinch roller 22, a test of turning-over the recording paper P (1-2) at a time of fixing the turning-over pinch roller 24, a test of transportation and turning-over (1-3) at a time of enabling to rockingly move the transport pinch roller 22, and a test of transportation and turning-over (1-4) at a time of enabling to rockingly move the transport pinch roller 22 and the turning-over pinch roller 24, have been conducted. Easiness of transporting the recording paper P and the presence or absence of the recording paper's waist (rigidity) have been examined in the case of respectively setting the weight of the recording paper P to 35 kg, 45 kg, 55 kg, 70 kg, 90 kg and 110 kg. In the judgment result shown in FIG. 6, the marks "*", "O", "Δ", and "X" respectively signify "best", "good", "bad", and "worst".

As is apparent from the results of the experiment shown in FIG. 6, when both of the transport pinch roller 22 and the turning-over pinch roller 24 were enabled to rockingly move, best results could be obtained.

Consequently, a paper turning-over apparatus of further high stability can be obtained by the structures of the present invention.

Next, rigidity of the recording paper P (buckling) and the turning-over function (efficiency) of the recording paper P were examined by changing the reverse transportation force (for transporting the recording paper in the reverse direction) of the turning-over mechanism portion under the conditions of (1-4) shown in FIG. 6. The results of the experiments thus examined is illustrated in summary in the table of FIG. 7 (the table showing results of a second experiment).

In the second experiment, the presence or absence of the recording paper's waist (rigidity) or buckling and the turning-over function (efficiency) for turning-over the recording paper P have been examined in a case of respectively setting the transporting force for transporting the recording paper P in the opposite (reverse) direction to 10 gf, 20 gf, 30 gf, 50 gf, 70 gf, 90 gf, 110 gf, 130 gf, 150 gf, 170 gf and 200 gf, and in a case of respectively setting the weight of the recording paper P to 35 kg, 45 kg, 55 kg, 70 kg, 90 kg and 110 kg.

As is apparent from the results of the second experiment shown in FIG. 7, the reverse transportation force of the turning-over mechanism 25 can be set to 10 gf in a case of employing recording paper P not heavier than 55 kg. Furthermore, if the weight of the recording paper P is in the range of 55 kg–110 kg, the reverse transportation force enables the recording paper P to stably turn over at a value of 50 gf–200 gf.

The reverse transportation force can be determined by a combination of the number of concave and convex portions of the turning-over roller 23, the number of concave and convex portions of the turning-over pinch roller 24 having concave and convex portions alternated with the concave and convex portions of the turning-over roller 23 and opposing the turning-over roller 23 in a state of non-contact, a tension of the turn-over pinch roller 24, and a material of the convex portions of the turning-over roller 23.

As one benefit of the present invention, the transport roller 21 and the transport pinch roller 22 respectively have thereon concave and convex portions which are mutually alternated and the turning-over roller 23 and the turning-over pinch roller 24 respectively also have thereon concave and convex portions mutually alternated. The turning-over roller 23 can then be driven by the transport roller 21 and is rotated subsequently thereto. As shown in FIG. 3, a waist (rigidity) is given to the recording paper P, and thereby the recording paper P can be transported to the turning-over mechanism as shown in FIG. 4 without being put in a bending (buckling) state.

When the rear end PE of the recording paper P moves past the transport roller 21, the rear end PE is automatically nipped by the nip portion formed between the transport roller 21 and the turning-over roller 23 and the recording paper P is turned over. Therefore, the turning-over pinch roller 24 does not need to attach to or detach from the turning-over roller 23. Furthermore, it then becomes possible to omit a sensor for detecting a rear end of the recording paper P, a motor for rotating the turning-over roller 23 in the reverse direction, a changing-over claw for changing a recording paper path, etc.

Consequently, with the present invention it turns out to be possible to provide a recording paper turning-over apparatus which can perform an operation of turning-over recording paper with high reliability and high speed. The apparatus can be constructed with a simple structure having superior stability in a small space, and thereby the apparatus can be manufactured with low cost.

As a further benefit of the present invention, when the rear end PE of the recording paper P moves past the transport mechanism portion composed of the transport pinch roller 22 and the transport roller 21, the rear end PE of the recording paper P can be surely guided to the turning-over path 27 when the rear end PE of the recording paper P is brought into contact with the transport roller 21 by action of the reverse transport force of the turning-over portion composed of the turning-over roller 23 and the turning-over pinch roller 24.

As a further benefit of the present invention, buckling of the recording paper P can be prevented.

As a further benefit of the present invention, even if the thickness of the recording paper P is increased and the rigidity thereof becomes high, an increase of the transportation load can be prevented.

As a further benefit of the present invention, since the tangent line passing through the nip portion between the turning-over roller 23 and the turning-over pinch roller 24 impinges downstream of the nip portion of the transport roller 21, the rear end PE of the recording paper P can be smoothly guided to the turning-over path 27.

As a further benefit of the present invention, a braking operation is exerted upon the recording paper P by restricting the direction of transporting the recording paper P to the side of the turning-over roller 23 by use of restriction guide 35, and as a result the recording paper P transported to the sheltering path 26 (see FIG. 1) can be prevented from jumping out therefrom.

As a further benefit of the present invention, as the transport roller 21, transport pinch roller 22, the turning-over roller 23, and the turning-over pinch roller 24 can be combined as one unit, reliability of the turning-over operation can be increased, and thereby easiness of handling the apparatus can be further improved.

As a further benefit of the present invention, the recording paper P can be transported into the turning-over mechanism portion by use of the transport mechanism portion. Furthermore, the recording paper P can be surely turned over by the turning-over mechanism, etc., and there is no fear of damaging the recording paper P.

As a further benefit of the present invention, the driving source for driving the transport roller 21 and the turning-over roller 23 can be put in one place, and as a result any other separate motor and force transmitting system (mechanism) can be omitted. Thereby, it is possible to reduce both space for assembling the apparatus and manufacturing cost.

Many other various modifications can be applied to the present invention in connection with the structure, the shape, and the function, etc., in particular, the arrangement of the transport roller, the transport pinch roller, the turning-over roller, the turning-over pinch roller, the shape of those rollers, and the driving mechanism portions for driving those rollers.

Obviously, numerous additional modifications and variations of the present invention are possible in light of the above teachings. It is therefore to be understood that within the scope of the appended claims, the present invention may be practiced otherwise than as specifically described herein.

The present application is based on Japanese priority document 9-073,882 filed on Mar. 26, 1997, the contents of which are incorporated herewith by reference.

I claim:

1. A recording paper turning-over apparatus, comprising:

a transport roller having concave and convex portions;

a transport pinch roller having concave and convex portions and engaged with said transport roller, wherein said concave and convex portions of said transport pinch roller are alternated with said concave and convex portions of said transport roller;

a turning-over roller disposed downstream of said transport roller and having concave and convex portions, wherein the concave portions of said turning-over roller are in contact with the convex portions of said transport roller, and which turns-over the recording paper in relation to a direction of entry of the recording paper; and a turning-over pinch roller having concave and convex portions and engaged with said turning-over roller, wherein said concave and convex portions of said turning-over pinch roller alternate with said concave and convex portions of said turning-over roller;

wherein the recording paper is fed by said transport roller driving said transport pinch roller to push the recording paper between said turning-over roller and said turning-over pinch roller, and wherein, when a rear end of the recording paper moves past a nip portion between said transport roller and said turning-over roller, the rear end of the recording paper is brought into contact with an outer circumference of said transport roller, and the recording paper is fed between said transport roller and said turning-over roller, in order to turn over the recording paper.

2. The recording paper turning-over apparatus as defined in claim 1, wherein an outer circumferential surface of the convex portion of said transport roller is knurled.

3. The recording paper turning-over apparatus as defined in claim 1, wherein said turning-over pinch roller is positioned in accordance with a thickness and rigidity of the recording paper.

4. The recording paper turning-over apparatus as defined in claim 1, wherein a gap between said transport pinch roller and said transport roller is changed in accordance with a thickness and rigidity of the recording paper.

5. The recording paper turning-over apparatus as defined in claim 1, wherein said turning-over roller and said turning-over pinch roller are arranged such that a tangent line passing through a nip portion between said turning-over roller and said turning-over pinch roller is inclined from a nip portion between said transport roller and said transport pinch roller toward a direction of said transport roller.

6. The recording paper turning-over apparatus as defined in claim 1, further comprising a guide for guiding the recording paper to a side of said turning-over roller.

7. The recording paper turning-over apparatus as defined in claim 1, wherein said transport roller, transport pinch roller, turning-over roller and turning-over pinch roller are formed in one housing, and wherein said one housing includes:

a recording paper inlet portion formed upstream of said transport roller;

a recording paper tip end outlet portion, from which a tip end side of the recording paper passing through a nip portion of said turning-over roller and said turning-over pinch roller is discharged; and a recording paper rear end outlet portion, from which the rear end of the recording paper turned over at a nip portion of said transport roller and said turning-over roller is discharged.

8. The recording paper turning-over apparatus as defined in claim 1, wherein a reverse transporting force for reversely transporting the recording paper guided in from a transport mechanism composed of said transport roller and said transport pinch roller is set to 10 gf–200 gf.

9. The recording paper turning-over apparatus as defined in claim 1, wherein the concave portions of said transport roller are always in contact with the convex portions of said turning-over roller, and wherein said turning-over roller is driven by a driving force of said transport roller.

10. A method of turning-over a recording paper comprising the steps of:

rotating a transport roller having concave and convex portions in a direction of drawing in the recording paper;

engaging a transport pinch roller having concave and convex portions with said transport roller, wherein said concave and convex portions of said transport pinch roller alternate with said concave and convex portions of said transport roller;

disposing a turning-over roller having concave and convex portions downstream of said transport roller, wherein the concave portions of said turning-over roller are in contact with the convex portions of said transport roller, and which turn-over the recording paper in relation to a direction of entry of the recording paper; and engaging a turning-over pinch roller having concave and convex portions with said turning-over roller, wherein said concave and convex portions of said turning-over pinch roller alternate with said concave and convex portions of said turning-over roller;

wherein the recording paper is fed by said transport roller and said transport pinch roller to push the recording paper between said turning-over roller and said turning-over pinch roller, and wherein, when a rear end of the recording paper moves past a nip portion between said transport roller and said turning-over roller, the rear end of the recording paper is brought into contact with an outer circumference of said transport roller, and the recording paper is fed between said transport roller and said turning-over roller, in order to turn-over the recording paper.

11. The method of turning-over the recording paper as defined in claim 10, wherein an outer circumferential surface of the convex portion of said transport roller is knurled.

12. The method of turning-over the recording paper as defined in claim 10, further comprising the step of:

positioning said turning-over pinch roller in accordance with a thickness and rigidity of the recording paper.

13. The method of turning-over the recording paper as defined in claim 10, further comprising the step of:

positioning said transfer pinch roller such that a gap between said transport pinch roller and said transport roller can be changed in accordance with a thickness and rigidity of the recording paper.

14. The method of turning-over the recording paper as defined in claim 10, wherein said turning-over roller and said turning-over pinch roller are arranged such that a tangent line passing through a nip portion between said turning-over roller and said turning-over pinch roller is inclined from a nip portion between said transport roller and said transport pinch roller toward a direction of said transport roller.

15. The method of turning-over the recording paper as defined in claim 10, further comprising the step of:

providing a guide for guiding the recording paper to a side of said turning-over roller.

16. The method of turning-over the recording paper as defined in claim 10, further comprising the step of:

disposing a turning-over unit constructed as a unit in a housing, wherein said housing includes:

a recording paper inlet portion formed upstream of said transport roller;

a recording paper tip end outlet portion, from which the tip end side of the recording paper passing through a nip portion of said turning-over roller and said turning-over pinch roller is discharged once; and a recording paper rear end outlet portion, from which the rear end of the recording paper turned over at a nip portion of said transport roller and said turning-over roller is discharged.

17. The method of turning-over the recording paper as defined in claim 10, further comprising the step of:

setting a reverse transporting force for reversely transporting the recording paper guided in from a transport mechanism composed of said transport roller and said transport pinch roller to 10 gf–200 gf.

18. The method of turning-over the recording paper as defined in claim 10, further comprising the steps of:

always bringing the concave portions of said transport roller into contact with the convex portions of said turning-over roller;

driving said turning-over roller by a driving force of said transport roller; and turning-over the recording paper only by the driving force of said transport roller.

* * * * *